US009975606B2

(12) United States Patent
Trouve

(10) Patent No.: US 9,975,606 B2
(45) Date of Patent: May 22, 2018

(54) FAIRLEAD FOR GUIDING AN ANCHORING ELEMENT

(71) Applicant: DCNS, Paris (FR)

(72) Inventor: Arnaud Trouve, Gond-Pontouvre (FR)

(73) Assignee: DCNS, Paris (FR)

( * ) Notice: Subject to any disclaimer, the term of this patent is extended or adjusted under 35 U.S.C. 154(b) by 0 days. days.

(21) Appl. No.: 15/036,781

(22) PCT Filed: Nov. 12, 2014

(86) PCT No.: PCT/EP2014/074386
§ 371 (c)(1),
(2) Date: May 13, 2016

(87) PCT Pub. No.: WO2015/071318
PCT Pub. Date: May 21, 2015

(65) Prior Publication Data

US 2016/0280333 A1 Sep. 29, 2016

(30) Foreign Application Priority Data

Nov. 15, 2013 (FR) ..... 13 61239

(51) Int. Cl.
*B63B 21/10* (2006.01)
*B63B 21/18* (2006.01)
*B63B 21/50* (2006.01)

(52) U.S. Cl.
CPC ..... *B63B 21/10* (2013.01); *B63B 21/18* (2013.01); *B63B 21/50* (2013.01)

(58) Field of Classification Search
CPC ..... B63B 21/04; B63B 21/10; B63B 21/18; B63B 21/50
(Continued)

(56) References Cited

U.S. PATENT DOCUMENTS 2,599,200 A * 6/1952 Rogers ..... B63B 21/18 114/179
3,289,626 A * 12/1966 Petrie ..... B63B 21/18 114/200

(Continued)

FOREIGN PATENT DOCUMENTS

FR 2984 272 A1 6/2013
WO WO 2010/085156 7/2010

OTHER PUBLICATIONS

Feb. 11, 2015 International Search Report for PCT/EP2014/074386 (1 page).

(Continued)

*Primary Examiner* — Michael E Gallion
(74) *Attorney, Agent, or Firm* — Knobbe, Martens, Olson & Bear, LLP

(57) ABSTRACT

The invention relates to a fairlead for guiding an anchoring element, allowing the anchoring of a unit, such as a floating unit, to an anchoring point, and in particular being applicable to permanent anchoring devices of the submerged fairlead type with an integrated chain stopper, in fields such as the marine, offshore, and renewable marine energy industries.

The fairlead comprises guide means 1 to 4 able to guide the translation of the anchoring element between the unit and the anchoring point, and blocking means 5 able to block the translation of the anchoring element in the guide means 1 to 4.

The blocking means 5 are mounted on the guide means 1 to 4 at least partially freely rotating around an axis parallel to the longitudinal axis of the anchoring element when the latter is guided in the guide means 1 to 4.

15 Claims, 3 Drawing Sheets

(58) Field of Classification Search
USPC ..... 254/389
See application file for complete search history.

(56) References Cited

U.S. PATENT DOCUMENTS 3,382,730 A * 5/1968 Roggatz ..... B66D 3/26 474/140
3,557,737 A * 1/1971 Smulders ..... B63B 21/18 114/200
3,810,359 A * 5/1974 Schreyer ..... F16G 17/00 254/391
4,398,387 A * 8/1983 Bary ..... B66D 3/16 254/371
4,497,471 A * 2/1985 Longberg ..... B63B 21/22 114/179
5,845,893 A * 12/1998 Groves ..... B63B 21/50 114/293
5,934,216 A * 8/1999 Childers ..... B63B 21/04 114/200
6,435,121 B2 * 8/2002 Siring ..... B63B 21/18 114/200
6,817,595 B1 * 11/2004 Jenkins ..... B63B 21/10 114/200
7,059,262 B2 * 6/2006 Dove ..... B63B 21/04 114/210
7,325,508 B2 * 2/2008 Boatman ..... B63B 21/10 114/180
8,770,039 B2 * 7/2014 Dang ..... G01L 5/101 73/828
8,915,205 B2 * 12/2014 Miller ..... B63B 21/10 114/200
9,199,697 B2 * 12/2015 Dang ..... B63B 21/18
9,475,679 B2 * 10/2016 Copin ..... B66D 3/20
2001/0035119 A1 * 11/2001 Siring ..... B63B 21/18 114/200
2005/0241558 A1 * 11/2005 Barlow ..... B63B 21/04 114/200
2012/0031320 A1 * 2/2012 Bauduin ..... B63B 21/502 114/264
2012/0160146 A1 * 6/2012 Miller ..... B63B 21/10 114/200
2013/0043447 A1 * 2/2013 Farrell, III ..... B66D 3/006 254/264
2013/0098214 A1 * 4/2013 Birkeland ..... B23D 15/00 83/18
2014/0339485 A1 * 11/2014 Busson ..... B63B 21/18 254/389
2016/0031684 A1 * 2/2016 Weingartner ..... B66D 3/12 254/389
2016/0280333 A1 * 9/2016 Trouve ..... B63B 21/10

OTHER PUBLICATIONS

Sep. 11, 2014 French Search Report for French Application FR 13 61239 (3pgs).

* cited by examiner

FAIRLEAD FOR GUIDING AN ANCHORING ELEMENT

FIELD OF THE INVENTION

The present invention relates to a fairlead for guiding an anchoring element. It is in particular applicable to permanent anchoring devices of the submerged fairlead type with an integrated chain stopper, in fields such as the marine, offshore, and renewable marine energy industries.

BACKGROUND OF THE INVENTION

The design of submerged anchoring devices, of the submerged fairlead type with an integrated chain stopper, require taking into account the forces experienced by the anchoring line at the device, the behavior of the anchoring line at the interface with the device and the ease of installing the anchoring line.

This type of equipment was first developed with offshore drilling platforms.

Long-term permanent anchors are common in the offshore sectors, with the examples of floating production supports of the FPSO (Floating Production Storage and Offloading) and FSRU (Floating Storage Regasification Unit) types, which can remain on their production site for several decades.

New developments in the Renewable Marine Energies (RME) field have completed the pre-existing offshore market.

Offshore structures such as floating production supports, construction or drilling platforms, loading and unloading buoys, and most recently RME floating platforms (offshore wind turbines, ocean thermal energies, etc.) are anchored on a desired site using anchoring lines made up of chains and/or cables connecting them to the anchoring points with the sea bed.

Typically, for permanent anchors, chains are used connected to the anchoring points, rising up to the floating unit via fairleads serving as chain entry guides. Traction systems for the chains (winches, windlasses, etc.) are also used, as well as retaining systems for the chains (chain stoppers) situated on the deck of the floating unit.

Due to their imposing sizes, the anchored platforms require the use of many chains, anchoring devices, anchors and complementary equipment. Furthermore, to avoid increasing the bulk existing on the deck of these platforms, the anchoring devices are placed outside the deck, for example on the hull clapboards, whether above the water or submerged in it.

In general, the anchoring lines are preinstalled and connected to the anchoring points. Messenger lines are then run, from the deck of the floating unit, in the fairleads, terminal connectors connecting these messenger lines to the anchoring lines.

The anchoring lines are next tensed to the pretension required for anchoring, then the chain stoppers are activated to keep the anchoring lines in their configuration.

One of the requirements of this type of anchoring device is that they must make it possible to allow the chain and/or the cable, the line accessories (Kenter links, special connectors) and the messenger line to pass.

Once the platform is secured by its anchoring, the anchoring chains are continuously working under the stresses caused by the wind, the swell, the tides and the currents. The movements produced on the anchoring chains accelerate the fatigue failures of the chains if fairleads with a curved guide or small-radius cable wheel are used. That is why the anchoring devices are generally designed with curved guides or cable wheels with a large radius.

Anchoring equipment of this type is known, like that described in U.S. Pat. No. 4,742,993. This involves a fairlead with a curved guide for anchoring cables able to rotate freely around a vertical axis connected to the floating unit.

In this document, the device is designed for cables, and therefore does not comprise a submerged chain stopper.

Another type of anchoring equipment is described in U.S. Pat. No. 5,441,008. This involves a fairlead mounted via a double pivot link on a rigid arm at the end of which a chain stopper is integrated.

The system uses a tubular body connected to an articulated separate assembly, and does not make it possible to allow the cable of the messenger line, the chain, the Kenter links and the special connectors to pass, as is generally required in the installation of anchoring lines.

None of these anchoring devices can be used on anchoring systems currently in place. Indeed, the existing technology uses a bulky submerged fairlead having a cable wheel with 7 pockets. During the installation, a messenger cable is unwound from the floating unit, then connected by an assistance vessel of the AHTS (Anchor Handling Tugs Supply) type to the anchoring line installed beforehand. The messenger line is next pulled from the floating unit, causing the cable of the messenger line and the line accessories that are present to pass, via the fairlead, to a massive piece of deck equipment on which the chain is next mounted. This piece of equipment makes it possible to perform the final phase of the installation by setting the anchoring line to the correct pretension. When the required pretension is obtained, the chain stopper is engaged.

The fact that the chain stopper is located on the deck of the floating unit therefore clutters the deck in parallel with increasing the forces thereon. Due to this presence on the deck, the loads transmitted by the anchoring lines are returned on the deck, which requires the use of a more massive, and therefore more cumbersome, piece of equipment to withstand and transmit the loads.

Another type of anchoring equipment is known as described in U.S. Pat. No. 5,845,893. This involves a fairlead with an integrated chain stopper having the architecture that is currently the most widespread.

The foundations fixing the system to the floating support have a pivot link with a vertical axis with a first moving body. This body is used to guide the anchoring chain via the use of a cable wheel or a curved guide that is directly integrated. An arm, having the chain stopper at its end (anchoring point site), is connected to the pivoting body via a pivot link with a horizontal axis ultimately making it possible to accommodate azimuth and elevation angle variations of the anchoring line.

However, the only means of performing maintenance is to leave the operation site and return the floating unit to a dry hold.

An improvement of the maintenance of the system is described in U.S. 2012/0160146. This therefore involves facilitating the maintenance of the system described in U.S. Pat. No. 5,845,893 by adding, in the upper and lower parts of the foundations, guide pins allowing the upward removal of the equipment.

In all of these systems, the stopper is stationary, which causes any twisting or torsion to be reacted on the link following the one maintained in the stopper. In the case of an extreme twisting, this may be particularly harmful to the fatigue strength of the anchoring chain.

The loads and stresses that weigh on the anchoring lines at the floating support are of different types: corrosion and wear phenomena, impacts, flexural fatigue (primarily from out-of-plane flexion), major stresses, twisting/torsion phenomenon of the lines.

The known systems generally respond to the out-of-plane flexural fatigue issue, but none of them resolve the twisting/torsion issue of the anchoring line. During twisting of the anchoring line, the chain behaves nonlinearly, which disrupts its normal operation. Furthermore, during extreme twisting (approximately 15°), the fatigue lifetime of the link undergoing this twisting drops quite sharply.

One aim of the invention is therefore to resolve the aforementioned problems, by proposing an anchoring device of the submerged fairlead type with an integrated chain stopper that resolves the twisting/torsion issue of the anchoring line at the interface with the anchoring device.

Thus, the invention relates to a fairlead for guiding an anchoring element having a longitudinal axis and allowing the anchoring of a unit, such as a floating unit, to an anchoring point, said fairlead comprising guide means able to guide the translation of the anchoring element between the unit and the anchoring point, and blocking means able to block the translation of the anchoring element in the guide means.

The blocking means are mounted on the guide means at least partially freely rotating around an axis parallel to the longitudinal axis of the anchoring element when the latter is guided in the guide means.

According to different alternative embodiments, the system according to the invention comprises one or more of the features below, which may be considered alone or according to any technically possible combination(s).

- the guide means comprise a bearing ring and first rotation limiting means, and the blocking means comprise a pivoting support mounted pivoting against the bearing ring, and provided with a second rotation limiting means able to cooperate with the first rotation limiting means to limit the rotation of the blocking means,
- the first rotation limiting means comprise at least one circular groove forming at least one arc of circle centered on the rotation axis of the blocking means, and the second rotation limiting means comprise at least one element able to be guided in the circular groove,
- the blocking means comprise at least one blocking element of the gate type mounted pivoting on the support between a first blocking position in which the blocking element is able to block the anchoring element in translation in the guide means, and a second position without blocking in which the blocking element leaves the anchoring element freely translating in the guide means,
- the blocking element(s) are provided with mechanical, hydraulic or electric actuating means, allowing the passage of these blocking elements from the blocking position to the position without blocking, and vice versa,
- the actuating means comprise at least one element of the jack type whereof one end is connected to the support and the other end is connected to the blocking element, such that the deployment of the actuating means drives the pivoting of the blocking elements from the blocking position toward the position without blocking,
- the actuating means comprise at least one cable fixed on the blocking element, for example via an element of the ring type, such that traction on the cable drives the pivoting of the blocking element from the blocking position toward the position without blocking,
- the guide means comprise a first guide assembly designed to guide the anchoring element in a first direction and comprising a fastening interface allowing the fastening of the fairlead on the unit, and a second guide assembly, mounted pivoting relative to the first guide assembly around an axis and intended to guide the anchoring element in a second direction forming a nonzero angle relative to the first direction, and the blocking means are mounted on the second guide assembly,
- the first guide assembly comprises a guide support mounted freely rotating, around an axis parallel to the first direction, relative to the fastening interface, and a guide defining at least part of the passage for the anchoring element,
- the pivot axis of the second guide assembly relative to the first guide assembly is formed in a first guide part and substantially opposite the blocking means,
- the guide means comprise transition means making it possible to guide the anchoring element at the transition between the first and second guide directions,
- the transition means comprise an element of the guide wheel type mounted freely rotating around an axis formed in a second part of the guide,
- the transition means comprise an element of the curved guide type formed, or housed, in the guide,
- the guide means comprise a guide cone intended to facilitate the entry of the anchoring element in the second guide element.

Thus, the solution proposed by the invention secures the fatigue behavior of the chain, by reducing the major deterioration that occurs in the case of extreme twisting between two links, owing to the torsional flexibility of the chain stopper system, also called blocking means, over a defined angle range.

The flexibility authorizes the stopper, and therefore the link of the chain held by the stopper, to pivot around the axis of the anchor line. The tension forces and other flexion behaviors, in-plane and out-of-plane, are still present the first links situated downstream from the chain stopper (held link and following links), but the twisting/torsion phenomenon is passed on to several additional links situated upstream from the chain stopper. The torsional loads are then distributed over more links than in the traditional case and the risk of appearance of extreme twisting is greatly reduced.

BRIEF DESCRIPTION OF THE DRAWINGS

The features and advantages of the invention will appear upon reading the following description, provided solely as a non-limiting example, in reference to the following appended drawings.

DETAILED DESCRIPTION

Figure 1:
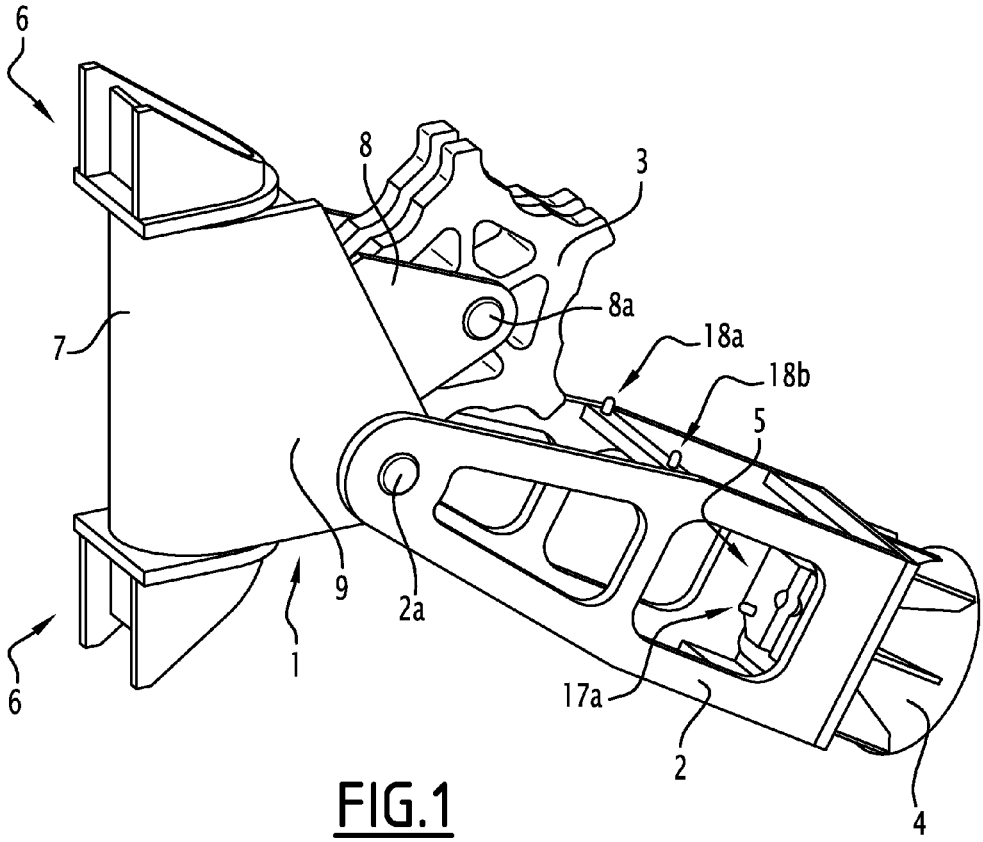
FIG. 1: diagrammatic illustration of one example guide fairlead according to the invention.
Figure 4A:
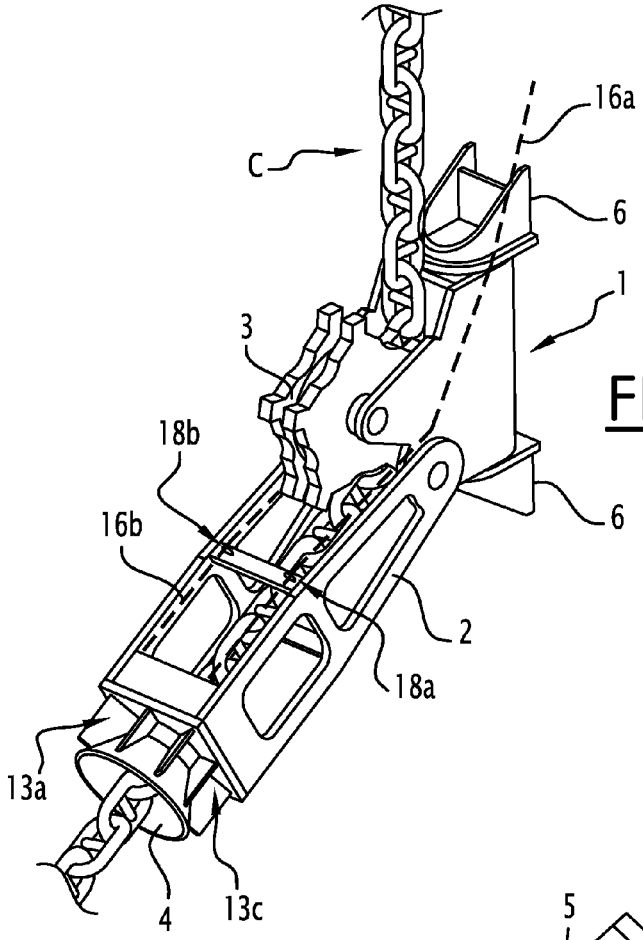
FIGS. 4*a*, 4*b*: diagrammatic illustrations of the fairlead of FIG. 1, with precisions on one example of mechanical actuating means for the blocking means.

The fairlead shown in FIGS. 1 and 4*a* first comprises a fastening interface 6 intended to interface with the floating unit.

The upper and lower parts of this fastening interface 6, generally called foundations 6, incorporate a rotation axis oriented vertically.

A guide support 7 pivoting around this axis is mounted between the two foundations 6. This guide support 7 constitutes a passage zone for the anchoring element C not shown in FIG. 1, but shown in FIG. 4A in the form of an anchoring chain C.

In this example, the guide support 7 supports a guide 8, 9 that at least partially defines a first passage for the anchoring element C.

The fastening interface 6, guide support 7 and guide 8, 9 assembly constitutes a first guide assembly 1 that makes it possible to guide the anchoring element C in a first direction.

In the example where the fairlead is fastened on a hull clapboard, for anchoring of a floating unit two anchoring points situated on the seabed, the first guide direction is generally substantially vertical.

Furthermore, a guide arm 2, extended by a guide cone 4 intended to facilitate the entry of the anchoring element C in the guide arm 2, form a second guide assembly 2, 4.

The guide arm 2 is mounted pivoting on the first guide assembly 1 via a rotation axis 2*a*, preferably perpendicular to the pivot axis of the guide support 7 of the first guide assembly 1.

In the example where the fairlead is fastened on a hull clapboard, for anchoring of a floating unit to an anchoring point situated on a seabed, the pivot axis of the guide support 7 of the first guide assembly 1 generally being substantially vertical, the axis 2*a* is substantially horizontal.

The second guide assembly 2, 4 is intended to guide the anchoring element C in a second direction that forms a nonzero angle with the first guide direction.

The second guide assembly 2, 4, in particular the arm 2, allows the system to accommodate elevation angle variations of the anchoring element C, which is an anchoring chain C in this example. This anchoring chain C passes in the arm 2 via the guide cone 4, then via blocking means not shown in FIGS. 1 and 4*a*, before going back up toward the first guide assembly 1.

Transition means 3 are provided to guide the anchoring element C at the transition between the first and second guide directions, therefore between the first guide assembly 1 and the second guide assembly 2, 4.

Figure 4B:
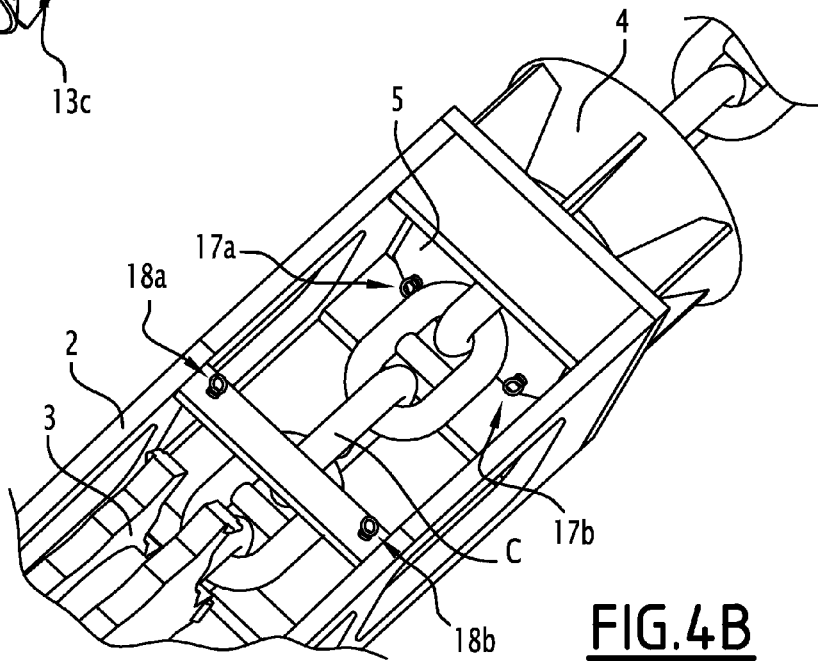

In the example shown in FIGS. 1, 4*a*, 4*b*, these transition means comprise an element of the cable wheel 3 type, provided with a groove in addition to its cavities. This cable wheel 3 is mounted freely rotating around an axis 8*a* formed in part 8 of the pivoting guide 8, 9 of the first guide assembly 1.

Another possibility for these transition means consists of integrating, within the pivoting guide 8, 9, a curved guide that is then formed, or housed, in that pivoting guide 8, 9.

Such a curved guide is comparable to a guide rail Incorporated in the pivoting guide 8, 9, with a given operating radius.

The first guide assembly 1, the second guide assembly 2, 4 and the transition means 3 therefore constitute guide means 1 to 4, which make it possible to guide the translation of the anchoring element C between the unit one wishes to anchor and the anchoring point.

Figure 2A:
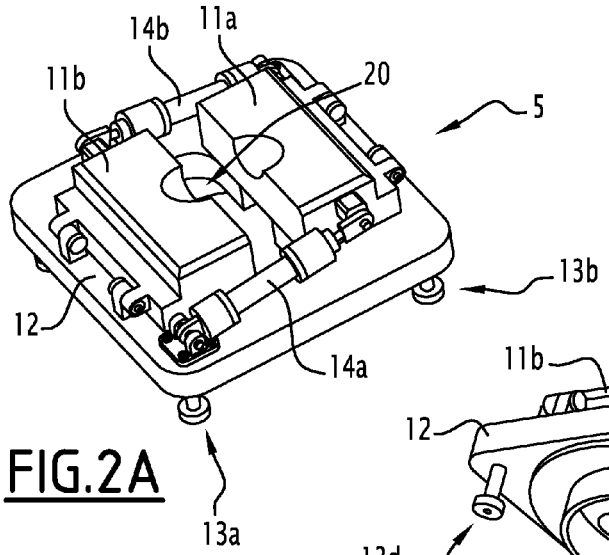
FIGS. 2*a* and 2*b*: diagrammatic illustrations of an example of blocking means equipping the fairlead of FIG. 1.
Figure 2B:
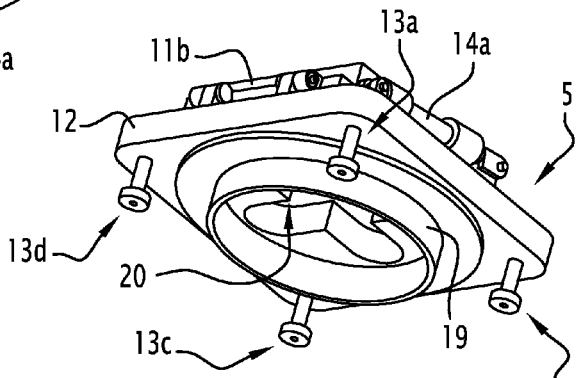

Blocking means 5, visible in FIGS. 1 and 4*b*, but shown in more detail in one example in FIGS. 2*a* and 2*b*, are mounted on the guide means 1 to 4, with a certain degree of rotational freedom around an axis parallel to the longitudinal axis of the anchoring element C.

These blocking means 5, which are also called chain stopper 5 when the anchoring element C is an anchoring chain C, are preferably mounted at the end of the arm 2 of the second guide assembly 2, 4, substantially opposite the pivot axis 2*a* of the arm 2 relative to the guide 8, 9 of the first guide assembly 1.

In the example in particular shown in FIGS. 2*a* and 2*b*, the blocking means 5 comprise a pivoting support 12, 19. This pivoting support 12, 19 comprises a support element 12 provided with a ring 19, visible only in FIG. 2*b*. This ring 19 is mounted pivoting against a bearing ring 10 positioned in the guide means 1 to 4.

Figure 3A:
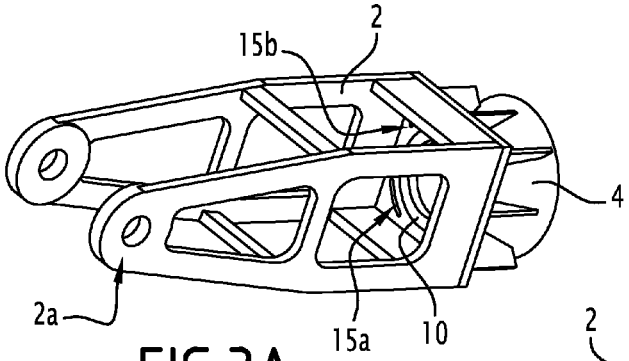
FIGS. 3*a* and 3*b*: diagrammatic illustrations of a second guide assembly forming part of the guide means of the fairlead of FIG. 1.
Figure 3B:
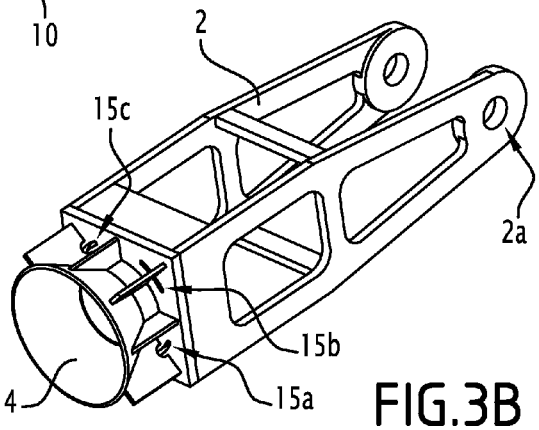

More specifically, in this example, the bearing ring 10 is positioned at the end of the arm 2 of the second guide assembly 2, 4, as shown in FIG. 3*a*.

Thus, the blocking means 5 can pivot on the arm 2, owing to the cooperation between the ring 19 and the bearing ring 10.

Furthermore, the blocking means 5 comprise second rotation limiting means 13*a* to 13*d* that cooperate with first rotation limiting means 15*a* to 15*d* positioned in the guide means 1 to 4.

More specifically, in this example, the first rotation limiting means 15*a* to 15*d* comprise circular grooves 15*a* to 15*d* centered on the rotation axis of the ring 19 relative to the bearing ring 10, therefore centered on the rotation axis of the blocking means 5.

Furthermore, the second rotation limiting means 13*a* to 13*d* comprise elements 13*a* to 13*d*, such as studs 13*a* to 13*d*, that are each guided in rotation in the circular grooves 15*a* to 15*d*.

The rotation and assembly of the blocking means 5 relative to the arm 2 can be obtained with a single circular groove 15*a* to 15*d* cooperating with a single element of the stud type 13*a* to 13*d*.

However, 4 circular grooves 15*a* to 15*d* and 4 stud-type elements 13*a* to 13*d*, equidistant on a circle centered on the rotation axis of the blocking means 5, are preferably used.

In the example in particular shown in FIGS. 2*a* and 2*b*, the blocking means 5 comprise two blocking elements 11*a*, 11*b* of the gate type 11*a*, 11*b* mounted pivoting on the support 12.

More specifically, these blocking elements 11*a*, 11*b* pivot on the support 12 between the blocking position, in which the anchor element C is blocked in translation in the guide means 1 to 4, and a position without blocking, in which the anchoring element C freely translates in these guide means 1 to 4.

In the example with two blocking elements 11*a*, 11*b*, of the gate type 11*a*, 11*b*, in the blocking position, the gates 11*a* and 11*b* stop the anchoring element C, which passes in an opening 20 in the support 12, thus blocking its translation. In the position without blocking, these gates 11*a* and 11*b* pivot while moving away from the support 12, which results in freeing the anchoring element C.

The shape of the opening 20 in the support 12, and the gates 11*a*, 11*b*, depends on the nature of the anchoring element C.

Thus, in the example illustrated in the figures, the anchoring element C is a chain C made up of several links, and the opening 20 has a shape adapted to the passage of each link of the chain C. Furthermore, the shape of the gates 11*a*, 11*b* is suitable for blocking the chain C between two of its links in the blocking position.

In another example, like that shown in FIG. 4*b*, a single blocking element of the gate type is used (not shown) for the blocking means 5. In such an example in the blocking position, the single gate stops the anchoring element C against the edge of an opening formed in the support 12, thus blocking its translation. In its position without blocking, the single gate pivots moving away from the support 12, thus freeing the anchoring element C.

Thus, the blocking means 5 or stopper 5 are allowed to pivot around the longitudinal axis of the anchoring line, at the end of the second guide assembly 2, 4, in a predefined angular range. In the described example, the authorized angular range is defined by the dimension of the studs 13*a* to 13*d* and the length of the groups 15*a* to 15*d*.

Remote actuating means are provided on the blocking means 5, in order to allow the activation or deactivation of the translational blocking of the anchoring element C in the guide means 1 to 4.

A first example of actuating means 14*a*, 14*b* is shown in FIGS. 2*a* and 2*b*. This involves electric or hydraulic means 14*a*, 14*b*, which allow the passage of the blocking element(s) 11*a*, 11*b* from the blocking position to the position without blocking, and vice versa.

This may involve actuators of the hydraulic or electric jack 14*a*, 14*b* type. One actuator 14*a*, 14*b* of this type will therefore be used per blocking element 11*a*, 11*b*.

Specifically, one of the ends of each actuator 14*a*, 14*b* is connected to the support 12, in rotation around an axis parallel to the main plane of the support part 12, and opposite the pivot axis of the associated blocking element 11*a*, 11*b* relative to the free end of that blocking element 11*a*, 11*b*. The other end of each actuator 14*a*, 14*b* is connected to the associated blocking element 11*a*, 11*b*, rotating around an axis parallel to the pivot axis of the blocking element 11*a*, 11*b* relative to the support part 12.

The connection point of each actuator 14*a*, 14*b* to the associated blocking element 11*a*, 11*b*, is raised enough relative to the connection point of that actuator 14*a*, 14*b* with the support 12, and far enough from the pivot axis of that blocking element 11*a*, 11*b* relative to the support 12, such that the deployment of each actuator 14*a*, 14*b* effectively drives the pivoting of the associated blocking element 11*a*, 11*b* from the blocking position toward the unblocking position.

The hydraulic or electric cabling, not shown in the figures, rises up to the deck ancillaries, such that these actuating means 14*a*, 14*b* can be actuated remotely.

The actuating means can also be mechanical actuating means 16*a*, 16*b*, 17*a*, 17*b*, 18*a*, 18*b*, allowing the passage of the blocking element(s) 11*a*, 11*b* from the blocking position to the position without blocking, and vice versa.

One example of such mechanical means is shown partially in FIG. 1, as well as FIGS. 4*a* and 4*b*.

The principle of such mechanical means in particular consists of providing the entire system with cables and return accessories to allow remote actuation of the blocking elements 11*a*, 11*b*.

More specifically, the guide means 1 to 4 are provided with rings 18*a*, 18*b* making it possible to guide the cables 16*a*, 16*b* along the guide means 1 to 4. Such rings 18*a*, 18*b* can for example be positioned on the arm 2 of the second guide assembly 2, 4.

Each cable 16*a*, 16*b* is fastened on the blocking element 11*a*, 11*b*, for example by means of rings 17*a*, 17*b*.

Thus, traction on one of the cables 16*a*, 16*b* drives the pivoting of the associated blocking element 11*a*, 11*b* from the blocking position toward the position without blocking.

It is possible to provide forcible return means of the blocking elements 11*a*, 11*b*, such that when the cables 16*a*, 16*b* are released, these blocking elements 11*a*, 11*b* automatically return and stay in the blocking position.

It is also possible to provide a system for controlling the tension in the anchoring lines by using force sensors for example positioned on the arm 2.

The fairlead according to the invention therefore makes it possible to greatly reduce the forces due to the torsion on the part of the anchoring element C that is held at the blocking means 5. If an anchoring chain C is used, such forces are significantly reduced on the link that is held at the chain stopper 5.

This fairlead allows a rotation of the anchoring element C around its longitudinal axis over a defined angular range. This relative rotational freedom reduces all of the problems on the units for which the anchoring line may have twisted.

Furthermore, during operation, the possibility of freeing the link of an anchoring chain C from specific housings provided at the blocking element(s) 11*a*, 11*b* of the chain stopper 5 is greatly reduced.

This fairlead therefore improves the behavior of the anchoring line C, reduces the stresses experienced by the held portion of the anchoring line C, such as the held link of an anchoring chain C, and facilitates the installation of the anchoring line C during the connection of that anchoring line C to a unit, such as a floating unit.

The present description is provided as an example and is not limiting with respect to the invention.

In particular, the invention is not limited to the exclusive use of two blocking elements 11*a*, 11*b* in the blocking means, a single element, as shown in FIG. 4*b*, or more than two also being able to be appropriate.

The invention is also not limited to means for limiting the rotation of the blocking means 5 relative to the guide means 1 to 4, which consist of the cooperation between circular grooves 15*a* to 15*d* with studs 13*a* to 13*d*. Other solutions can be considered to obtain this limitation.

Additionally, the invention is not limited to the exclusive use of a transition means 3 of the cable wheel type. A transition means of the curved guide type (not shown) that is formed, or housed, in the pivoting guide 8, 9 may also be appropriate.

The invention claimed is:

1. A fairlead for guiding an anchor line having a longitudinal axis and allowing the anchoring of a unit to an anchoring point, said fairlead comprising a guider able to guide a translation of the anchor line between the unit and the anchoring point, and a lock able to block the translation of the anchor line in the guider along a local longitudinal axis of the anchor line where the lock acts on the anchor line, wherein the lock is mounted on the guider at least partially freely rotatable with respect to the guider around an axis parallel to the local longitudinal axis of the anchor line when the anchor line is guided in the guider.

2. A fairlead for guiding an anchor line having a longitudinal axis and allowing the anchoring of a unit to an anchoring point, said fairlead comprising a guider able to guide a translation of the anchor line between the unit and the anchoring point, and a lock able to block the translation of the anchor line in the guider along a local longitudinal axis of the anchor line where the lock acts on the anchor line, wherein the lock is mounted on the guider at least partially freely rotatable with respect to the guider around an axis parallel to the local longitudinal axis of the anchor line when the latter is guided in the guider, and wherein the guider comprises a bearing ring and a first rotation limiter, and wherein the lock-comprises a pivotable support mounted against the bearing ring and a second rotation limiter able to cooperate with the first rotation limiter to limit the rotation of the lock.

3. The fairlead according to claim 2, wherein the first rotation limiter comprises at least one circular groove forming at least one arc of a circle centered on the rotation axis of the lock, and wherein the second rotation limiter comprises at least one element able to be guided in the circular groove.

4. The fairlead according to claim 2, wherein the lock comprises at least one pivotable block of the gate type mounted on the support between a first blocking position in which the at least one pivotable block is able to block the anchor line from translating in the guider, and a second position without blocking in which the at least one pivotable block permits the anchor line to freely translate in the guider.

5. The fairlead according to claim 4, wherein the at least one block is provided with a mechanical, hydraulic or electric actuator, said actuator, allowing the passage of the at least one block from the blocking position to the position without blocking, and vice versa.

6. The fairlead according to claim 5, wherein the actuator comprises at least one jack wherein one end is connected to the support and the other end is connected to the at least one pivotable block, such that the deployment of the actuator drives the pivoting of the at least one pivotable block from the blocking position toward the position without blocking.

7. The fairlead according to claim 5, wherein the actuator comprises at least one cable fixed on the at least one pivotable block such that traction on the cable drives the pivoting of the at least one pivotable block from the blocking position toward the position without blocking.

8. The fairlead according to claim 1 wherein the guider comprises a first guide assembly configured to guide the anchor line in a first direction, the first guide assembly comprising a fastening interface configured to allow the fairlead to be fastened to the unit, and a second guide, the second guide being pivotably mounted relative to the first guide assembly around an axis and configured to guide the anchor line in a second direction in a nonzero angle relative to the first direction, and wherein the lock is mounted on the second guide.

9. The fairlead according to claim 8, wherein the first guide assembly comprises a guide support rotatably mounted relative to the fastening interface, the guide support being mounted around an axis parallel to the first direction, and a guide defining at least part of a passage for the anchor line.

10. The fairlead according to claim 9, wherein a pivot axis of the second guide relative to a pivot axis the first guide assembly is formed in a first part of the guide and substantially opposite the lock.

11. The fairlead according to claim 8 wherein the guider comprises a transitioner configured to guide the anchor line at the transition between the first and second guide directions.

12. The fairlead according to claim 11, wherein the transitioner comprises a guider wheel rotatably mounted around an axis formed in a second part of the guider.

13. The fairlead according to claim 8 wherein the guider comprises a guide cone configured to facilitate entry of the anchor line in the second guide.

14. The fairlead according to claim 1, wherein the unit is a floating unit.

15. The fairlead according to claim 7, wherein the at least one cable is fixed on the at least one pivotable block with a ring.

* * * * *